US010507348B2

(12) United States Patent
De Palo

(10) Patent No.: US 10,507,348 B2
(45) Date of Patent: Dec. 17, 2019

(54) APPARATUS AND METHOD FOR UPRIGHT DRUMMING AND EXERCISING

(71) Applicant: David Vincent De Palo, Ridgefield, CT (US)

(72) Inventor: David Vincent De Palo, Ridgefield, CT (US)

( * ) Notice: Subject to any disclaimer, the term of this patent is extended or adjusted under 35 U.S.C. 154(b) by 454 days.

(21) Appl. No.: 15/347,733

(22) Filed: Nov. 9, 2016

(65) Prior Publication Data

US 2017/0128762 A1 May 11, 2017

Related U.S. Application Data

(60) Provisional application No. 62/252,613, filed on Nov. 9, 2015.

(51) Int. Cl.

| | |
|---|---|
| ***A63B 5/08*** | (2006.01) |
| ***G10D 13/00*** | (2006.01) |
| ***A63B 71/06*** | (2006.01) |
| ***A63B 71/00*** | (2006.01) |

(52) U.S. Cl.

CPC ..... *A63B 5/08* (2013.01); *A63B 71/0622* (2013.01); *G10D 13/00* (2013.01); *G10D 13/006* (2013.01); *A63B 2071/0063* (2013.01); *A63B 2071/0625* (2013.01)

(58) Field of Classification Search

CPC ..... G10D 13/00; G10D 13/02; G10D 13/026–029; A63B 5/00; A63B 5/08–10; A63B 71/0622; A63B 2071/0625; A63B 2071/0633; A63G 31/14

See application file for complete search history.

(56) References Cited

U.S. PATENT DOCUMENTS

| | | | | | |
|---|---|---|---|---|---|
| 1,509,750 | A * | 9/1924 | Campbell | A63G 31/14 | 482/128 |
| 3,022,036 | A * | 2/1962 | Bassett | A63G 31/14 | 248/600 |
| 3,062,542 | A * | 11/1962 | Evancha | A63B 5/08 | 273/449 |
| 4,056,265 | A * | 11/1977 | Ide | A63B 69/0035 | 235/99 R |
| 5,277,675 | A * | 1/1994 | Shifferaw | A63B 5/08 | 482/142 |
| 2013/0345028 | A1* | 12/2013 | Bes | A63B 5/11 | 482/79 |
| 2016/0005386 | A1* | 1/2016 | Mori | G10D 13/026 | 84/421 |

* cited by examiner

*Primary Examiner* — Jennifer Robertson

(57) ABSTRACT

Aerobic and strength training percussion apparatus incorporating a specially designed bass drum with internal striking mechanism which is activated by such actions, but not limited to, the user jumping, walking, running, bouncing, dancing, or leaning atop it while simultaneously striking a plurality of smaller drums, mounted vertically on a frame, with specially weighted mallets. Apparatus can be utilized individually or in groups, either as an exercise device or a dedicated percussion instrument. Additionally, the base of the apparatus can be utilized as a percussion instrument, a percussion toy, and, when a multitude are place adjacent to one another, as a musical floor.

13 Claims, 12 Drawing Sheets

APPARATUS AND METHOD FOR UPRIGHT DRUMMING AND EXERCISING (THIS APPLICATION CLAIMS THE BENEFIT OF PROVISIONAL PATENT APPLICATION NO. 62/252,613, FILED NOV. 9, 2015)

FIELD OF THE INVENTION

The present invention relates generally to percussion instruments and aerobic strength training devices. More particularly, the invention relates to an apparatus comprised of a plurality of percussion instruments designed and employed in such a way that aerobic and strength training routines can be performed upon it. Additionally, the invention provides a method of sounding a drum through normal exercise actions such as but not limited to jumping, walking, running, and dancing.

BACKGROUND ART

Percussion instruments comprise a wide variety of musical devices well known in the prior art, including, but not limited to drums having one or more membranes, called drumheads, stretched over the end or ends of a hollow cylinder or shell. Sounds are produced by striking the drumhead with a stick, mallet, brush, or even the player's hand, or any portion thereof. The sound produced by a drum depends upon a variety of factors, including, among them, but not limited to; the shape, size, and thickness of the shell; the materials from which the shell is fabricated; the material comprising the drumhead; and the tensioning of the drumhead.

All drums are built to withstand constant pounding, however some drums, known as cajons, are constructed with wooden heads and can withstand even more battering than their animal skin or mylar-headed counterparts.

A Cajon is a box or cuboid shaped percussion instrument originally from Peru and traditionally constructed out of wood. Because of the superior durability of wood, cajons are often utilized when weather or atmospheric changes could damage traditional animal skin or synthetic drum heads. However even a bass cajon-drum cannot withstand the weight and stresses of a human being walking, running, dancing, or jumping upon it. And even if a thin resonant material were discovered that could withstand such stresses, the presence of the other foot while the user was stepping or walking atop the drum would effectively dampen the vibration and mute the drum.

An object of the current invention is to produce a bass drum which can be played by the user while they are standing, jumping, walking, or running upon it.

Commonly, bass drums are struck from the side, either with a mallet—as when being performed in a marching band or concert hall—or by a kick-drum pedal, utilized when the drum is situated in a drum set or kit setup. Alternatively, there is an upward firing pedal which strikes the underside of a floor-torn drum when the kit is meant to be performed by a standing player, commonly called an "upright" or "cocktail" kit. All pedal designs, however, require one foot or part thereof to depress a pedal before the attached mallet or hammer is triggered to hit the drum head, thereby limiting the user's range of motion for the associated foot.

An object of the current invention is to allow for a drum to be sounded by a player standing upon a platform raised or floating above said drum and either walking, running, leaning, or jumping upon said platform, thereby triggering a striking mechanism (described herein) situated either inside said drum or in the space between said floating platform and the resonant top of said drum by the simple redistribution of the player's weight, allowing the user to move both feet freely.

Kit drumming offers a wonderful workout for the upper body; the arms and hands specifically, and with modern double bass-drum pedal systems, advanced users can get quite an aerobic workout performing on a drum kit, however the drums must be played in a sitting posture; with common side effects including hemorrhoids and achilles tendon injuries. In addition, while it is accepted that the upper drums in a traditional drum kit are most ergonomically situated horizontally around the seated performer for speed and accuracy, if they were situated vertically, allowing the user to strike not only downward, but forward and upward as well, they would provide increased possibilities for upper body muscular development.

It is an object of the current invention to allow one to perform rhythmic patterns on vertically mounted drums deployed in such a way that striking them exercises specific muscles in the upper body while, at the same time, jumping, running, walking, or dancing on a floating spring-mounted platform above a specially designed bass drum creates a steady bass pattern, simultaneously exercising the lower body while providing aerobic workout for the cardiovascular system.

Bouncing to music is as natural as tapping one's foot and is very popular with younger adults and children. There is a style of music known as "rave" in which the most accepted and common form of dancing is bouncing along to a steady beat. Bouncing is fun but can become tiring on the feet, legs, and joints.

It is an object of the current invention to create an apparatus upon which users can jump or bounce that is in fact bouncy. Additionally, while bouncing is always fun—as evidenced by the popularity of trampolines—if one could make a sound like a "thump" or "knock" while bouncing it would make the process that much more satisfying when bouncing in time to music.

It is an object of the current invention to create a platform upon which users can jump and bounce while producing satisfying sounds on every landing.

SUMMARY OF THE INVENTION

The invented apparatus is designed to facilitate upright drumming both as a form of musical expression as wells as a method of rhythmic exercise. Specifically, the apparatus is designed to allow the feet to perform normal exercise actions such as but not limited to jumping, walking, running, bouncing, and dancing as a means of actuating the drum, the base upon which they are in motion and through which they activate a mechanism that strikes the resonant head of said drum from within; while the hands are free to strike a plurality of smaller drums attached to a frame situated vertically in front of the user using specially weighted mallets or sticks.

The advantage of having the drums situated vertically rather than the more ergonomically horizontal orientation utilized in drum kits is that the body of the user experiences a much more targeted upper body workout. In addition, because the method required to play the base of the apparatus requires constant motion of the legs, the user experiences an aerobic workout as well.

Additionally, the present invention can be viewed as a new musical instrument, as a toy, and as an acoustic platform for choreographed or interpretive dance. As an instrument, the base portion of the apparatus fulfills the function of a bass drum in a traditional drum kit, however the performer can be standing, leaning, walking, running or jumping in place atop it while simultaneously performing on the vertically mounted drums with mallets; essentially demonstrating the rhythm being performed in a much more visible way than by playing a traditional percussion instrument.

The base of the apparatus can also be utilized as an instrument or exercise apparatus on its own. It can be fitted with extra strikers if desired, and the resonant head of the drum can be augmented with bells, strings, snares, or any manner of special sound effect so that either one or both feet (while walking or running) will create separate and distinct sounds, while jumping would create a combination of those sounds.

As a toy, users could jump upon the base while listening to music, accentuating the beat with every jump and having fun doing it.

Multiple bases set up adjacent to one another could create a musical floor upon which dancers could perform choreographed or interpretive dances that create their own unique music as the dancers move across it.

And finally, the present invention provides a method for striking any drum utilizing a user's weight atop a platform, doing away with the need for a pedal completely.

BRIEF DESCRIPTION OF THE DRAWINGS

The accompanying drawings further describe the invention.

DETAILED DESCRIPTION AND BEST MODE OF CARRYING OUT THE INVENTION

The invented apparatus is designed to facilitate upright drumming as a method of exercise as well as a method of musical expression. Specifically, the apparatus is designed to allow the feet to perform normal exercise actions such as but not limited to jumping, walking, running, and dancing as a means of actuating the bass cajon-drum upon which they are in motion and through which they activate a mechanism that strikes the resonant head of said bass cajon from within; while the user concurrently strikes a plurality of drums attached to a vertically oriented frame situated in front of said bass cajon, sounding percussive tones as well as creating both a targeted upper body workout and an aerobic exercise.

The apparatus is made up of two distinct sections: the base (FIG. 1, 10), herein named the thumper, which, in the pictured embodiment, is a bass cajon-drum with an activity platform (FIG. 1, 11) attached above it upon which the user moves in ways which include but are not limited to dancing, jumping, running, bouncing, and walking in place, and which, through the dispersion of the user's weight upon the activity platform's surface as transmitted down from its underside and attached actuator (FIG. 1, 12) through the top or along the side of said bass cajon-drum itself, actuates a striker (FIG. 5, 40) which is situated inside said bass cajon-drum (FIG. 1, 10) or between said drum (FIG. 1, 10) and said floating platform (FIG. 1, 11) and which sounds the resonant head (FIG. 1, 13) of said drum with each activation; and the upright frame (FIG. 1, 20), which holds a plurality of smaller drums (FIG. 1, 30), which in the pictured application are three rectangular and one square open-backed cajon-drums that are situated on the vertically oriented frame and positioned in such a way that while moving upon said bass cajon (FIG. 1, 10) and creating a steady beat with the motion of the user's leg one can strike all said vertically mounted drums (FIG. 1, 30) with mallets or sticks and play against or with the steady rhythm created by the feet.

Figure 1:
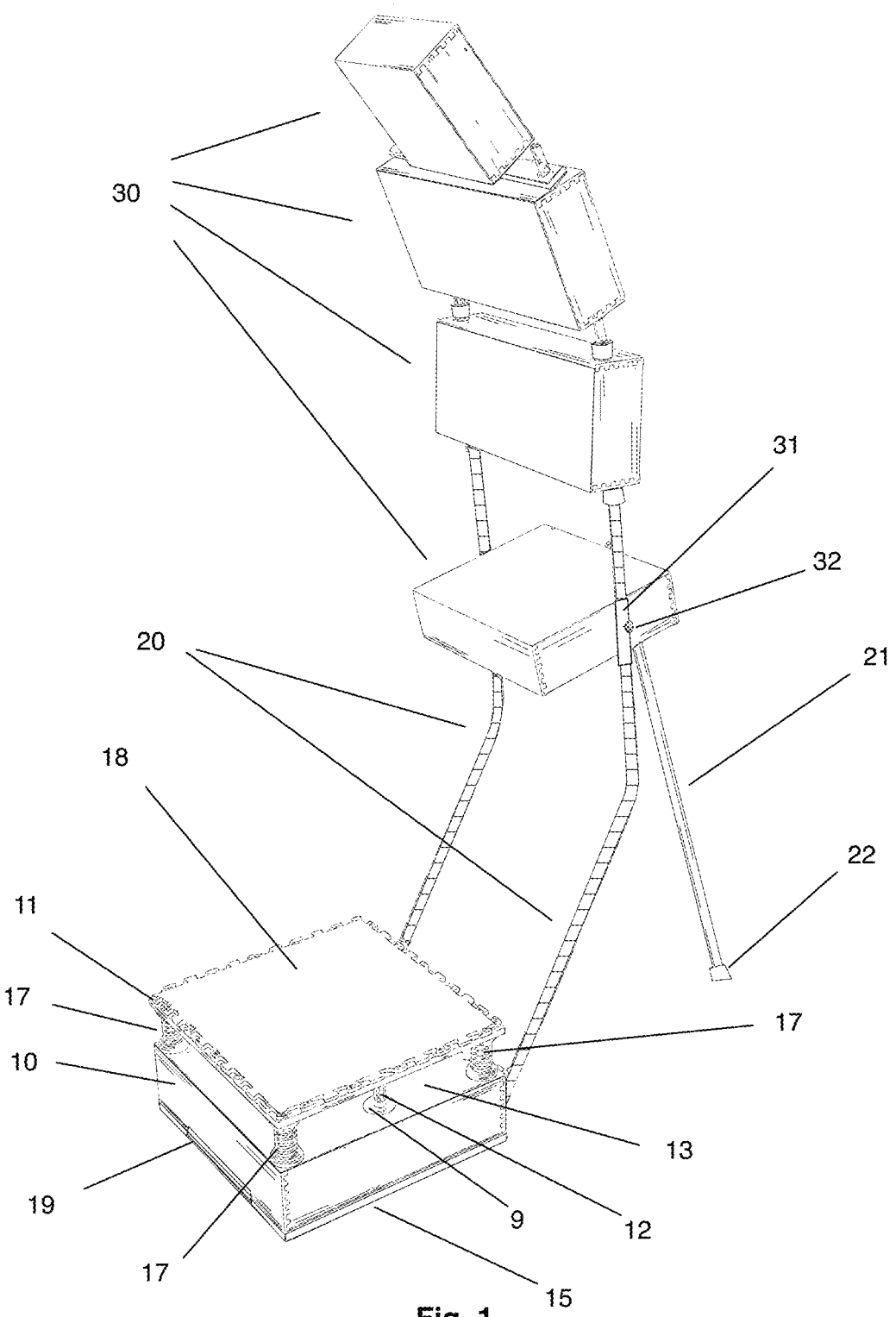
FIG. 1 is a perspective view of an assembled apparatus in accordance with one embodiment of the present invention including the base plus four upright drums on a vertical frame.
Figure 2:
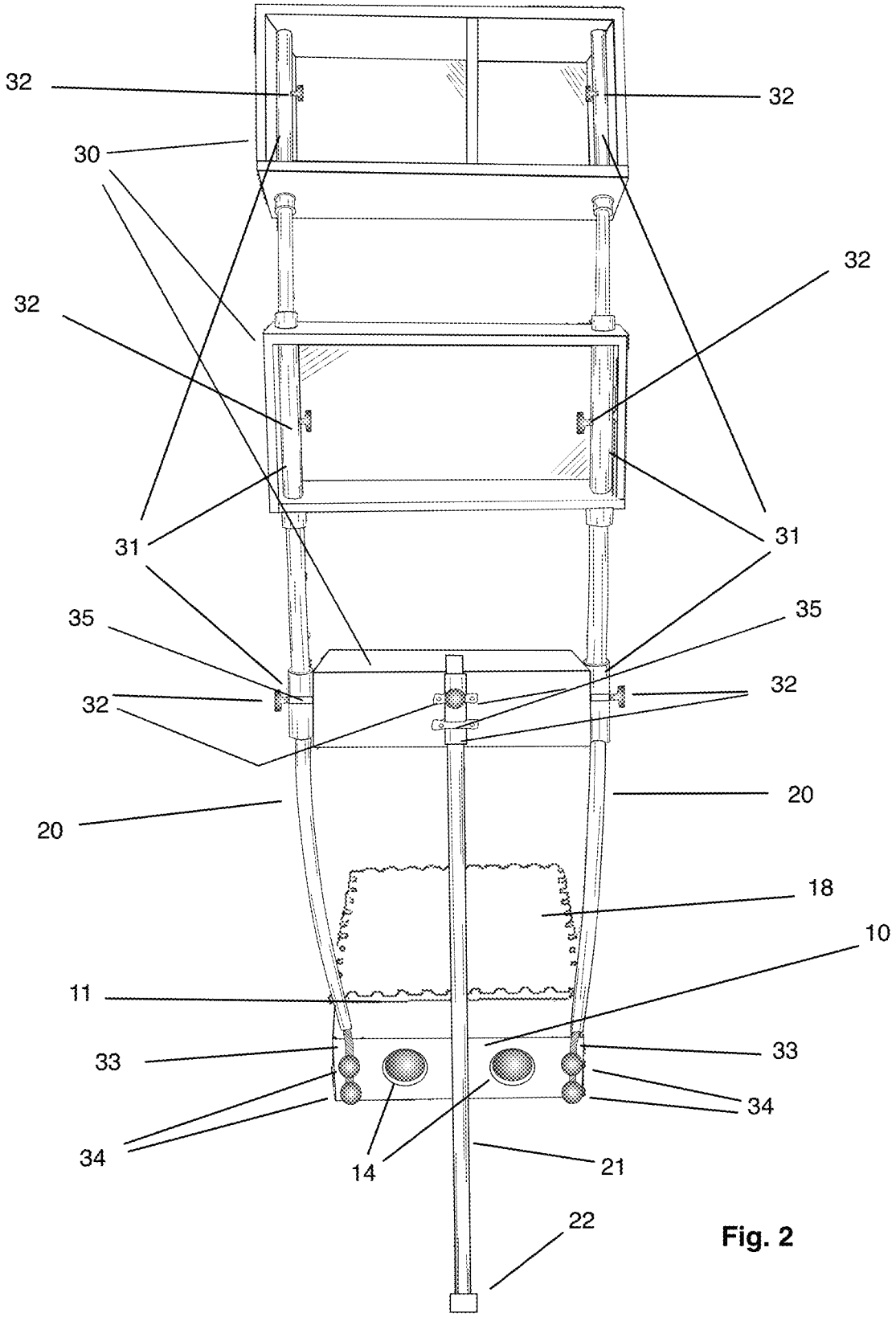
FIG. 2 is a back view of the apparatus displaying the front sound ports of the base as well as the pipe sleeves and set screw knobs used to adjust the drums up and down the upright frame.

Referring to FIG. 1, the upright frame (20) is shown in combination with the thumper (10). Both elements make up the invention, a rhythmic exercise apparatus/percussion instrument. The upright frame (20) is constructed of metal or some other material strong enough to hold the plurality of smaller drums arranged vertically along the frame (30) and to withstand the battering those drums will endure when in use. In the current embodiment, the metal of the frame is aluminum tubing, which renders the apparatus both light and strong, and is bent in such a way that the drums (30) supported along the frame (20) are all within comfortable striking distance of the user. The frame (20) is attached to the thumper (10) by sliding the frame (20) over the frame support bars (FIG. 2, 33) which are secured to the front of the thumper (10) with four frame support set screw knobs (FIG. 2, 34). All of the upright drums (30) are attached to the frame with drum securing sleeves (31) which, in the present embodiment, are made of aluminum pipe with a diameter large enough to slide over the aluminum tubing used for the upright frame (20). Once adjusted for optimal placement, the upright drums (30) are secured in position using set screw knobs (32). In the current embodiment, the upright drums are made from solid Birch, dovetailed for strength and aesthetics. All drums, including the bass-cajon thumper, are headed with ⅛" Baltic Birch plywood in the present embodiment. The upright frame (20) is stabilized both by the securing of the upright drums (30) along the frame, as well as for the tripod support bar (21) which is connected to the bottommost upright drum (30) and secured in place on the floor with a rubber tripod support foot (22).

Figure 3:
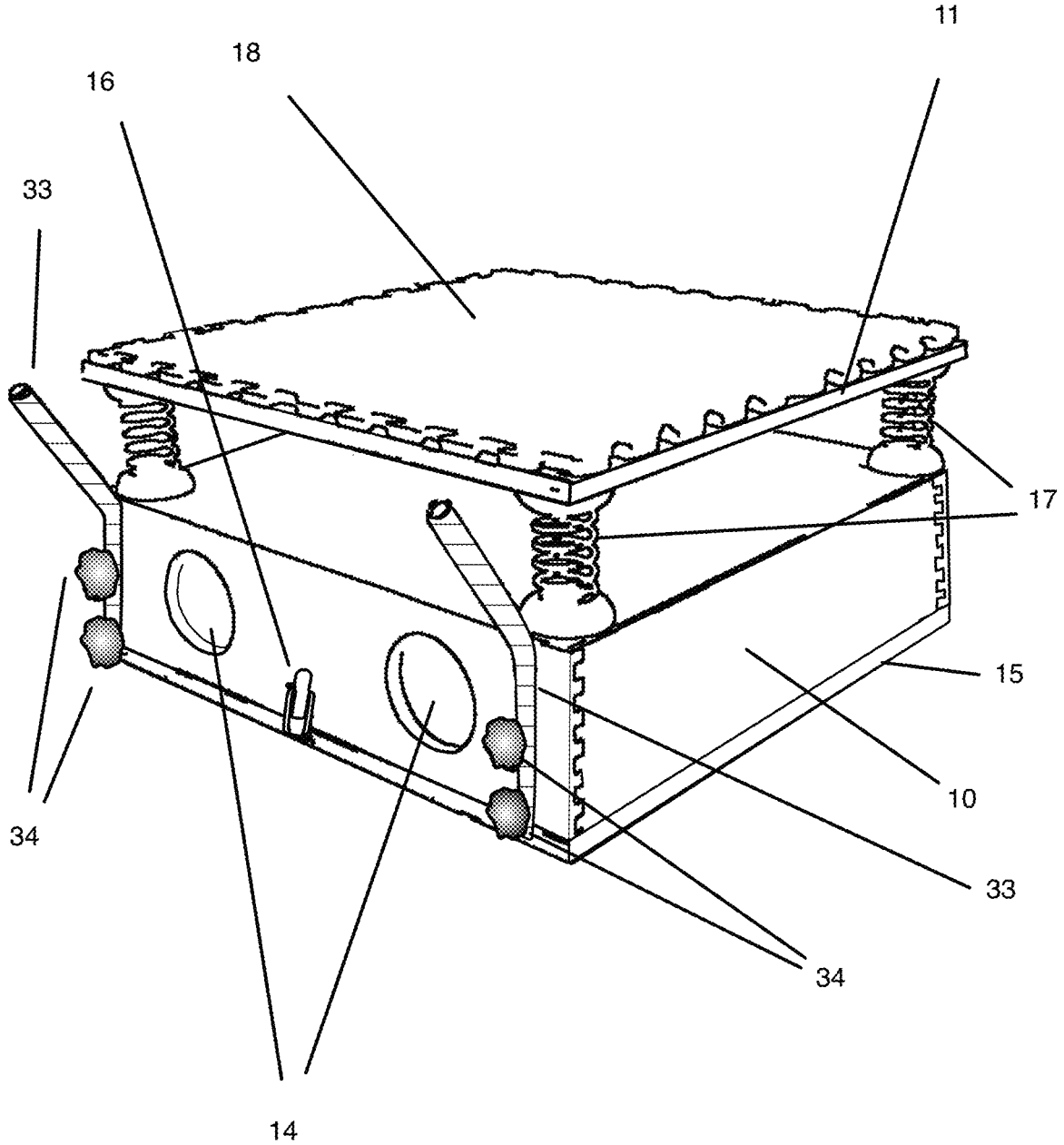
FIG. 3 is a perspective view of the base of the apparatus with its casing closed.
Figure 4:
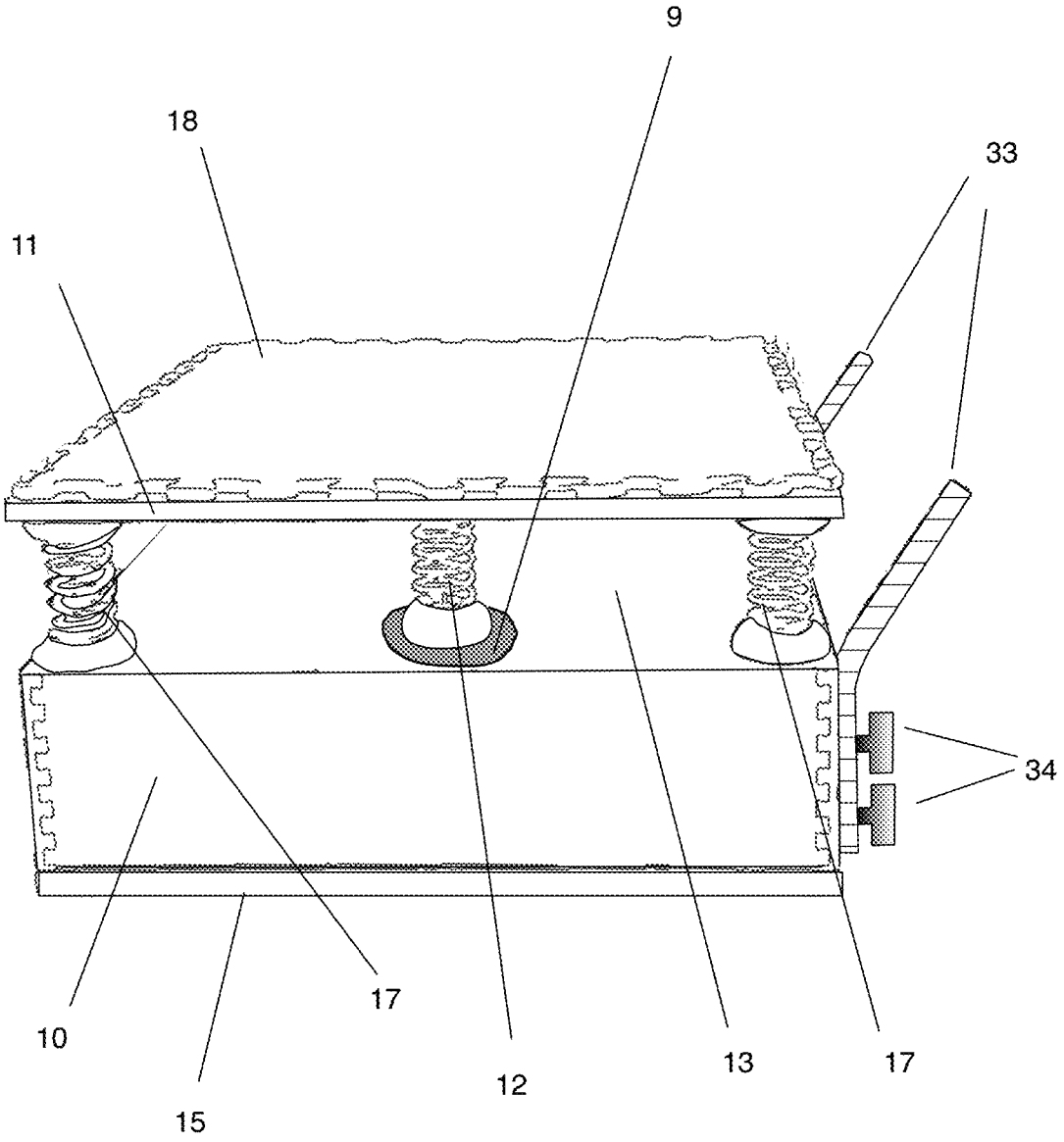
FIG. 4 is a right side view of the base of the apparatus showing the actuator and frame support bars.

In one manifestation, the thumper (10) is constructed of hardwood; the sound box is dovetail joined into a square frame. Two sound ports (FIG. 2, 14) are drilled into either the forward-facing or backward-facing side of said frame. A thick sheet of plywood (15) or some equally strong material is hinged (19) onto the base of said frame and secured with a hook or snap or latch (FIG. 3, 16). Rubber feet are glued or screwed onto said base to raise the box slightly off the ground to facilitate overall resonance as well as to hold the thumper steady when in use. A resonant head (13) of thin plywood or some other equally strong and resonant material is affixed to the top of said frame. The resulting box is a resonant bass cajon that can be opened and closed to install and access the striker (FIG. 4). A hole (9) is drilled into the resonant head (13) of said thumper (10) through which the actuator (12) can enter said thumper (10) and activate the striker (FIG. 5) when a user's weight depresses any part of the right (or left—depending on how the thumper is situated) side of the activity platform (11), which is another sheet of plywood or some other equally strong material attached atop the resonant head (13) of said thumper (10) via four or more springs or pistons (17) or other equally resilient material placed at each corner of the resonant head (13). Said activity platform (11) is covered with non-ski material (18) to protect users from slippage as well as to deaden the sound of the users' feet upon said activity platform. The actuator (12) is attached to the underside of said activity platform (11) in such a location that when the springs or pistons (17) are compressed on the side of which the actuator (12) is situated, it will pass cleanly through the hole drilled into the resonant head (13) and activate the striker (FIG. 8) causing the beater (FIG. 8, 41) to strike the resonant head (13) of said thumper (10) from within and create the desired sound.

Referring to FIG. 2, the invention is pictured from the back showing the forward face of the thumper (10) and the two sound ports (14) which allow the sound to escape from the sound box of the thumper (10) which, in the current embodiment, is made of solid Birch wood dovetailed into a square frame and headed with ⅛" Baltic Birch plywood. The thumper (10) is shown with attached activity platform (11) covered with non-skid surface (18) in connection with the upright frame (20) and three upright drums (30). The tripod support bar (21) is padded on the bottom end with the tripod support foot (22) and connected to the lowest of the upright drums (30) with the drum securing sleeve (31), which is held in place with two pipe clamps (35). Said lower upright drum (30), is locked in position with a set screw knob (32) on the tripod support bar (21), as well as with two laterally situated drum securing sleeves (31), both locked in place on the upright frame (20) with sect screw knobs (32). The other two upright drums (30) are connected to the upright frame (20) with two drum securing sleeves each (31), both internally situated and held in position with two set screw knobs (32) each. The upright frame (20) is connected to the front face of the thumper (10) by sliding said upright frame (20) over the frame support bars (33) which, in the current embodiment, are short pieces of EMT (electrical metallic tubing) of a diameter narrow enough to fit inside the upright frame (20) and bent at a 30° angle and attached to the front face of the thumper (10) with two frame support set screw knobs each (34).

Referring to FIG. 3, the thumper (10) is shown in perspective, displaying the base (15) and the base latch (16) which keeps the thumper (10) closed when it is lifted. Both frame support bars (33) are shown locked in position on the face of the thumper (10) by the four frame support set screw knobs (34). Two sound ports (14) are visible in the front face of the thumper (10). The activity platform (11) is covered by non skid surface (18) and secured above the sound box of the thumper with four springs (17) which in the current embodiment are gymnastic spring floor springs.

Referring to FIG. 4, the thumper (10) is shown from the side displaying the 30° angle of the frame support bars (33) secured in position on the face of the thumper with the frame support set screw knobs (34). The actuator (12) is shown in position above the actuator hole (9). In the current embodiment, the actuator (12) is the same type of spring (17) as used to support the activity platform (11) above the thumper (10).

Figure 5:
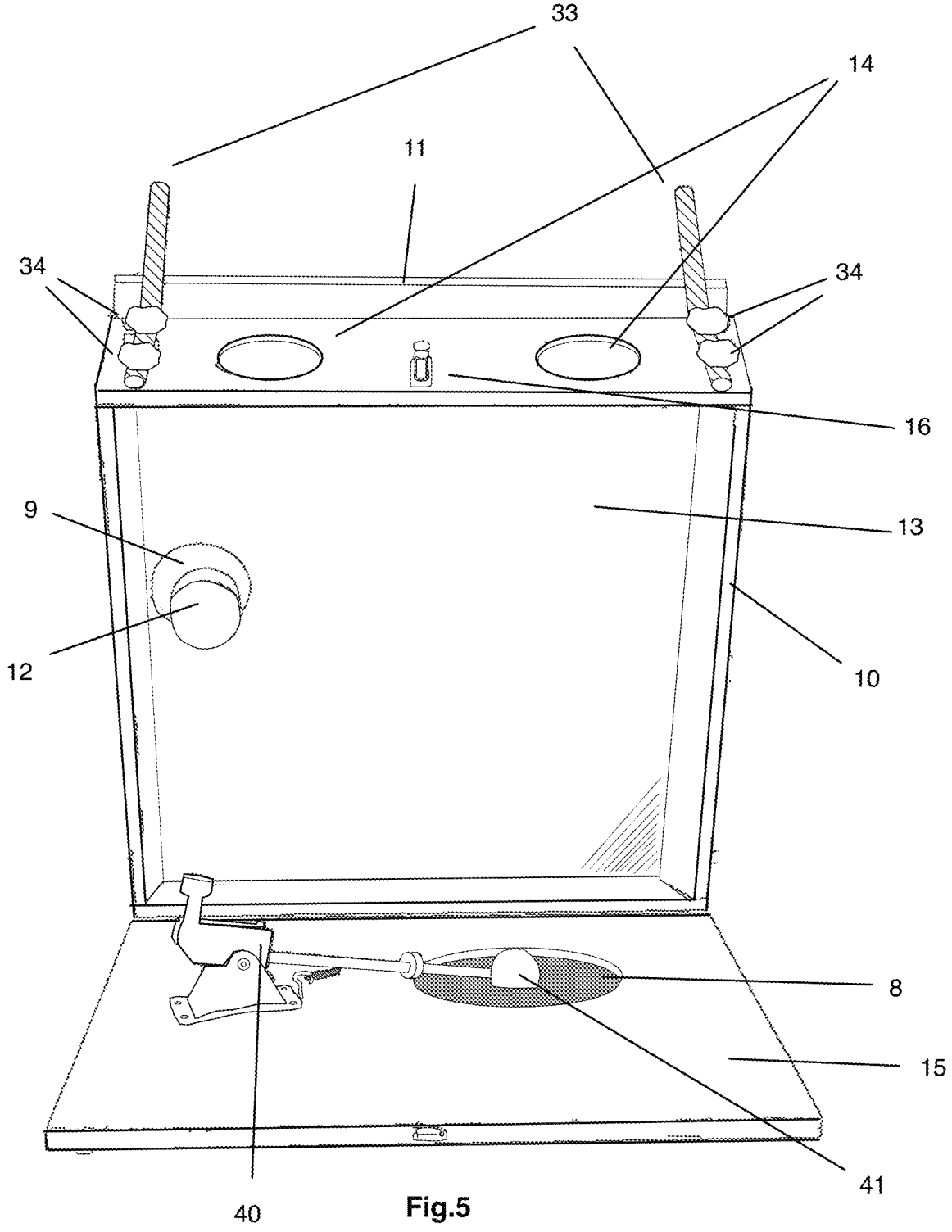
FIG. 5 is a front view of the base of the apparatus opened, displaying a striker, an actuator, and a hole in the resonant head of the base through which the actuator contacts the striker and causes a beater to strike the resonant head of the base from within.

Referring to FIG. 5, the thumper (10) is shown in the open position and from the front. The base of the thumper (15) has a striker (40) with attached beater (41) at rest in the beater hole (8) which is a hole cut into the base of the thumper (15) to prevent bounce back when the striker is in use. The actuator (12) can be seen coming through the resonant head (13) of the sound box via the actuator hole (9). Once reason why cajon type drums are currently preferred for construction of the thumper is the ability to cut through the resonant head (13) without delimiting the quality of sound produced.

Figure 6:
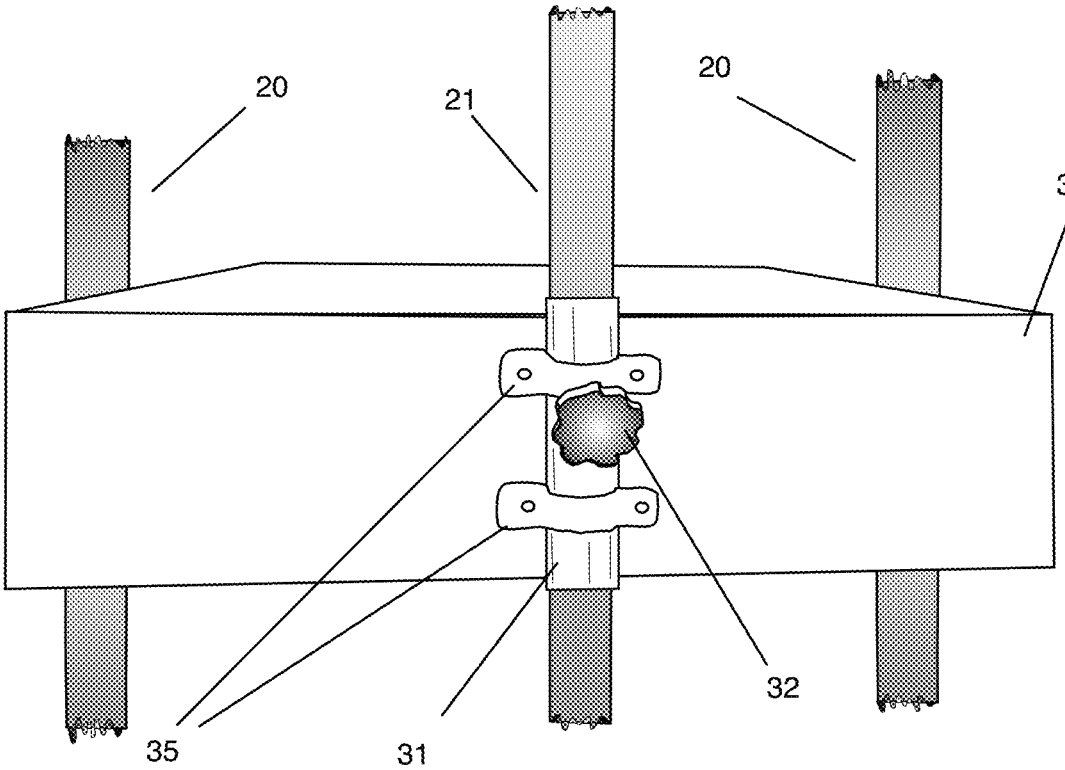
FIG. 6 includes two detail views of the lower upright drum and how it attaches to the upright frame and tripod support bar.
Figure 6:
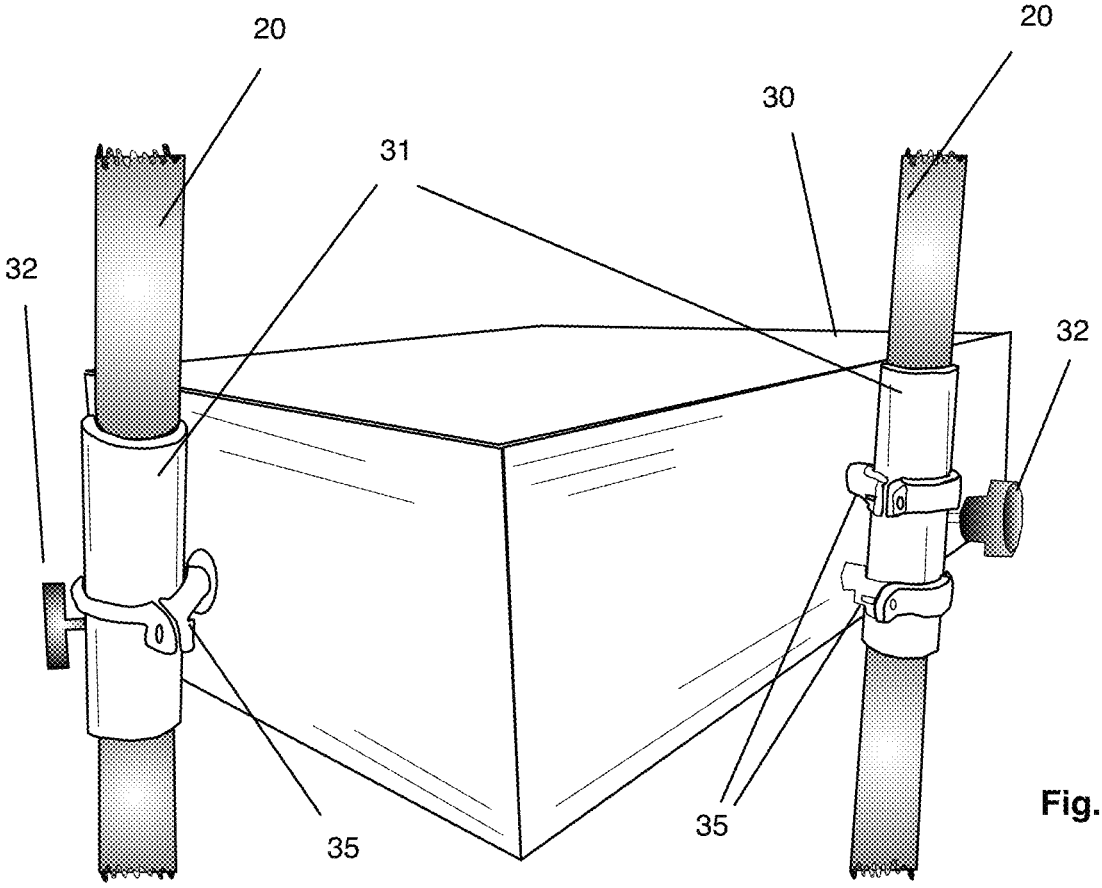

Referring to FIG. 6, the lower upright drum (30) is shown from the back and in perspective detailing the drum support sleeves (31) used to secure said drum (30) to the upright frame (20) and the tripod support bar (21). Said drum support sleeves (31) are attached to said drum (30) using pipe clamps (35) attached to said drum (30) and clamped around said drum support sleeves (31), which in the current embodiment are made of aluminum pipe of sufficient diameter to slide over the aluminum tubing of the upright frame (20). Said drum support sleeves (31) are the locked into position on the upright frame (20) and tripod support bar (21) with said set screw knobs (32).

Figure 7:
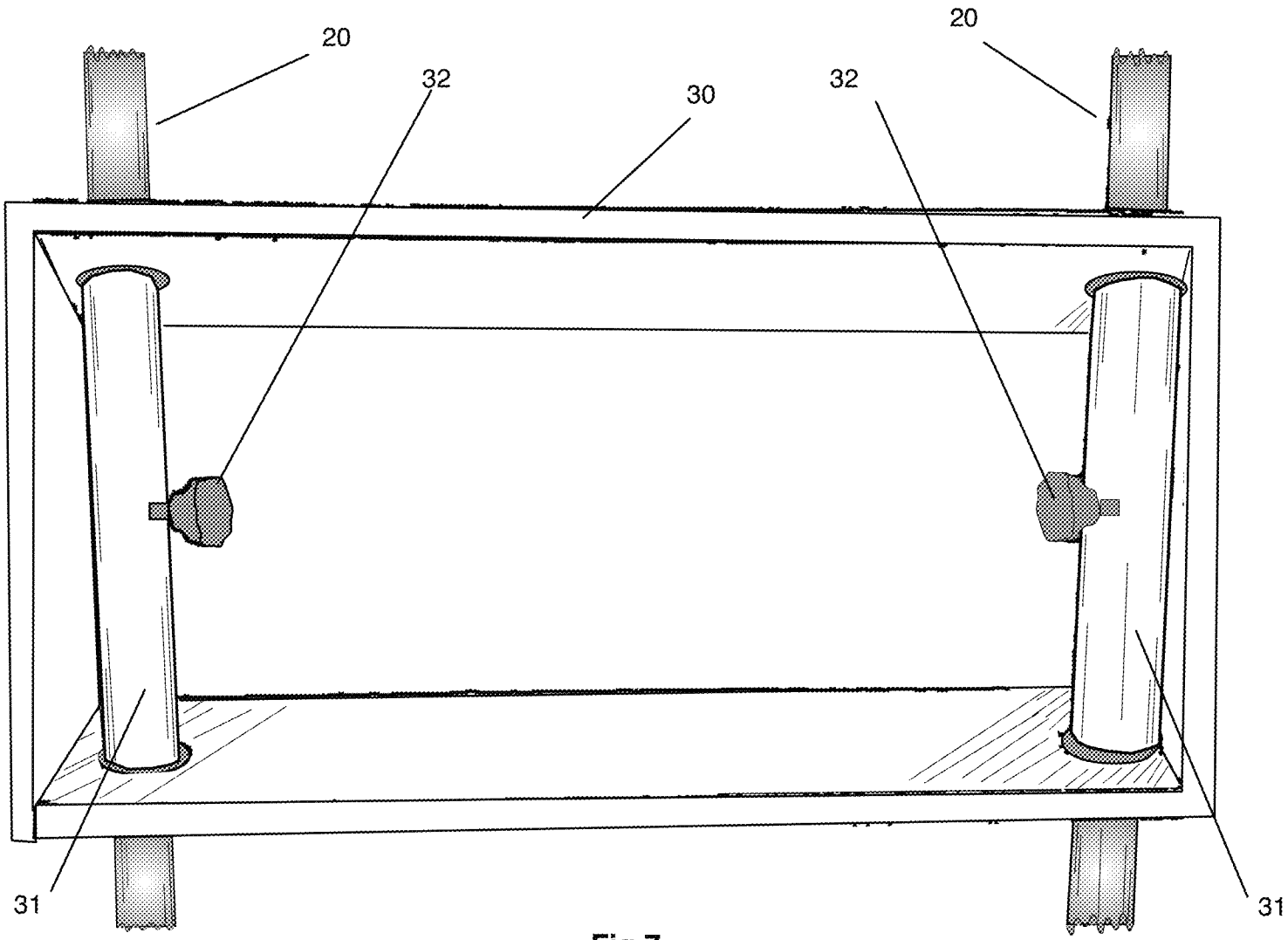
FIG. 7 is a back view of one of the upper drums and its two drum securing sleeves.

Referring to FIG. 7, one of the upright drums (30) is shown from the back detailing how the drum securing sleeves (31) pass through the open body of the upright drum (30) and allow said drum to slide up and down of the upright frame (20), both introducing stability to the upright frame (20) as well as adjustability for the upright drums (30). The set screw knobs (32) are loosened to adjust the drum (30) up and down along the frame (20) and then tightened once the drum has been positioned to the users specification.

Figure 8:
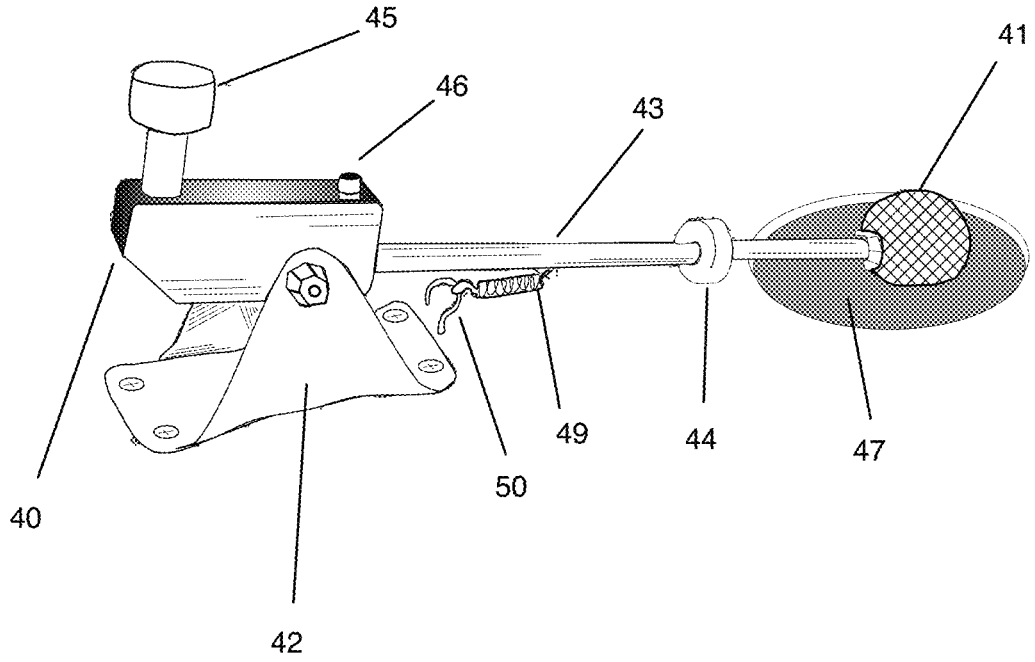
FIG. 8 shows two detail views of the striker assembly in a accordance with one embodiment of the present invention.
Figure 8:
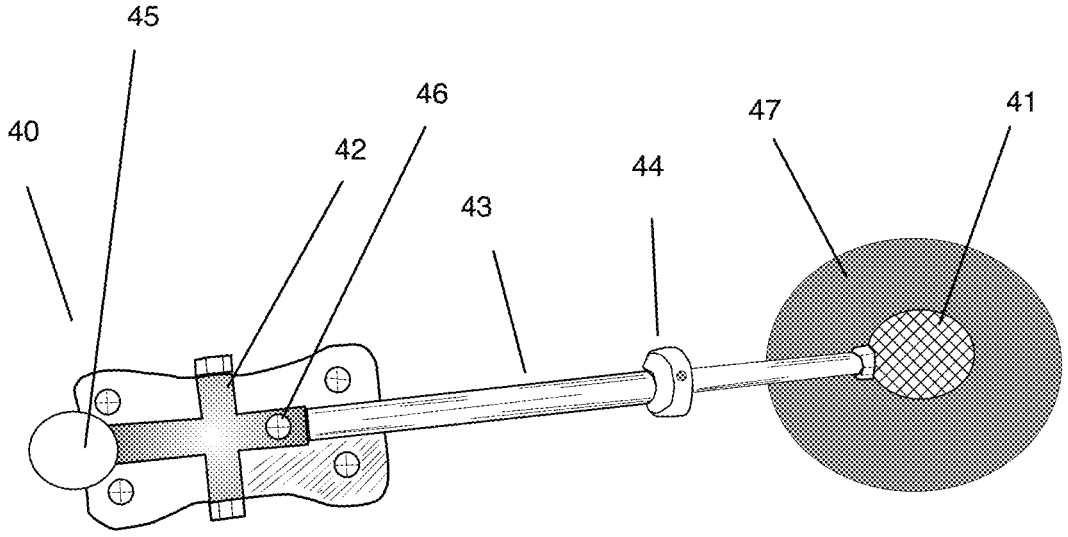

Referring to FIG. 8, two views of the striker (40) are shown, a perspective view and a view from above. The striker (40) consists of a fulcrum (42), striker arm (43), adjustment sleeve (44), and a beater (41). The striker (40) is attached to the base of the thumper (FIG. 5, 15) with screws or bolts. the striker body (40) is attached to the fulcrum via a hole in the striker body through which the fulcrum shaft passes. When depressed by the actuator, the striker contact pad (45) moves downward, causing the striker arm (43) and attached beater (41) to move upwards to the resonant head of the thumper (FIG. 1, 13) and sound said head. After activation, the striker arm (43) is pulled back into starting position by the beater return spring (49) which is connected to the base of the thumper (FIG. 1, 15) by the beater return spring hook (50). The striker arm (43) is secured to the body of the striker (40) with a striker arm set screw (46). The length of the striker can be adjust by sliding the beater (41) into the striker arm (43) by loosening the adjustment sleeve (44) and either shortening or lengthening to overall length based on the weight of the user (shorter for heavier, longer for lighter). The beater (41) is shown resting in the beater hole (8) which is a hole cut into the base of the thumper (15) to alleviate bounce back of the beater (41).

Figure 9:
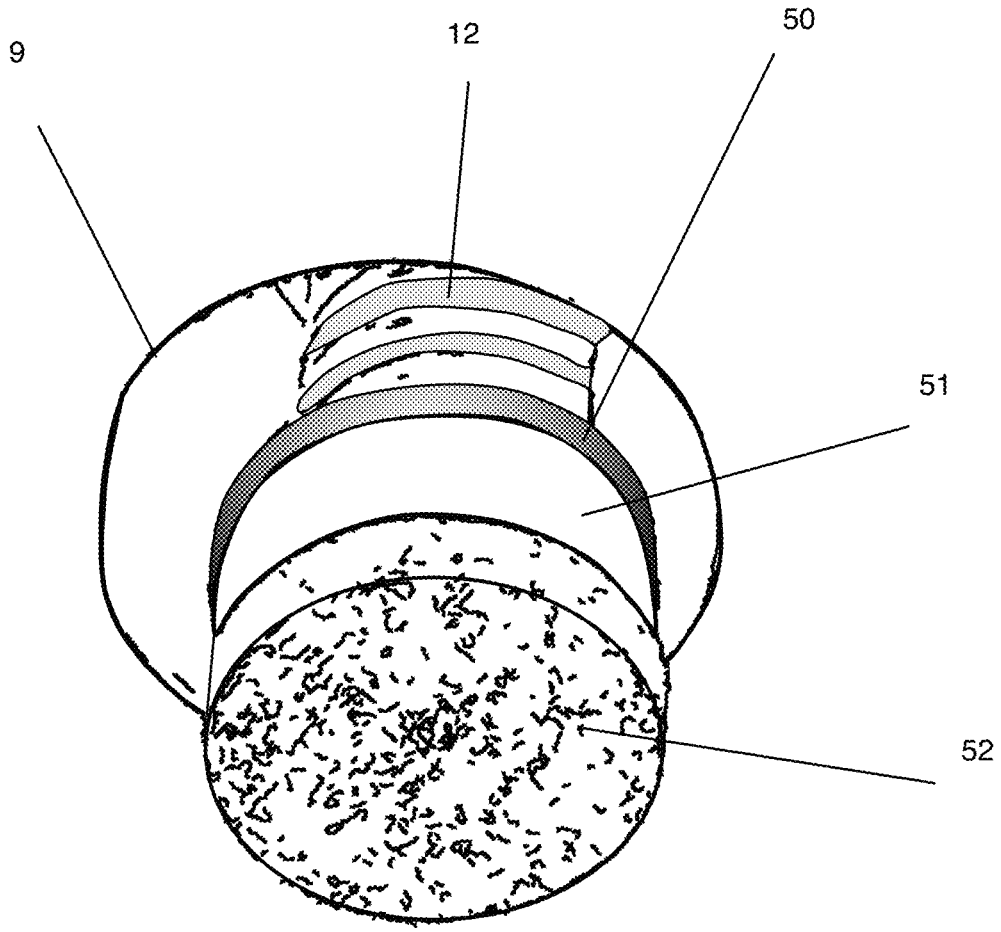
FIG. 9 is a detail view of the actuator assembly in a accordance with one embodiment of the present invention.

Referring to FIG. 9, is a detail of the actuator (12) coming through the actuator hole (9). The actuator is made from resilient material to solve the problem of bottoming out if the user depresses the activity platform more than is necessary to actuate the striker and sound the drum. In the even that the beater (FIG. 8, 41) hits the resonant head of the thumper (FIG. 1, 13) while the is still downward pressure on the activity platform (FIG. 1, 11) then the resilient material of the actuator (12) absorbs the momentum of the user, thus avoiding said activity platform corning to a solid bottom. In the current embodiment, said actuator (12) is comprised of a gymnastic spring-floor spring (FIG. 1, 17), actuator attachment bracket (50), actuator spacer attachment (51), and actuator contact pad (52). In the current embodiment, the actuator attachment bracket is the same device that is used to attach the springs to the thumper (10) sound box and the activity platform (FIG. 1, 11); the actuator spacer attachment (51) is a shaped piece of wood, thickness chosen to help extend the reach of the spring, and finished with the actuator contact pad (52) which in the current embodiment is a thick piece of felt. Felt is useful for the contact pad (52) since it aids in the soundless contact with the striker contact pad (FIG. 8, 45).

Figure 10:
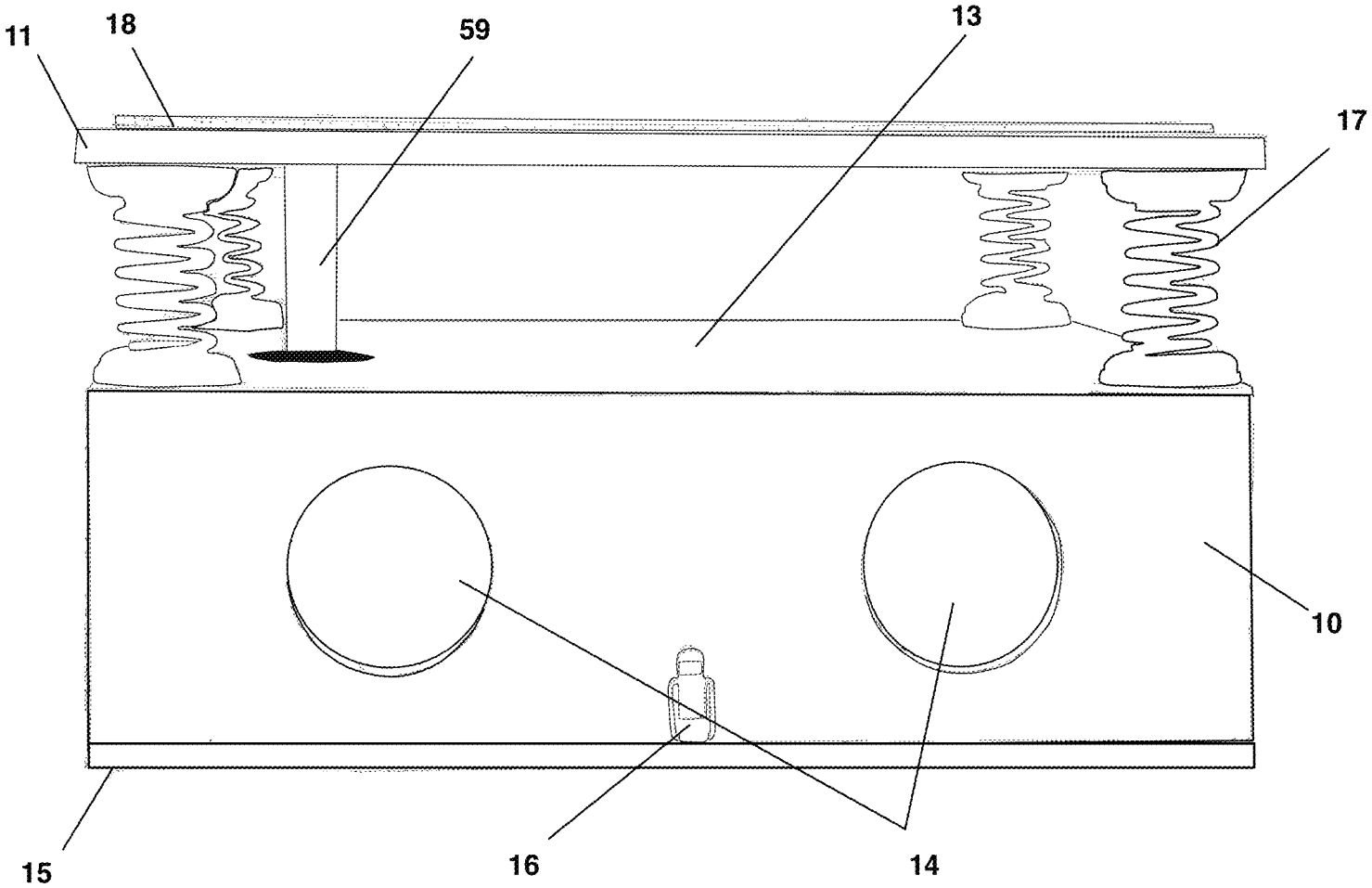
FIG. 10 is a front view of the base of the apparatus showing the sound ports and an alternate actuator assembly.

Referring to FIG. 10, the thumper (10) is shown closed from the front and comprising an alternate actuator (59). The activity platform (11) rests upon four springs (17). A thin mat of non skid material (18) is affixed to the top of said activity platform (11) to lessen the risk of users slipping as well as to deaden the sound of their shoes or feet upon said activity platform. In one embodiment of the invention this material is a cut portion of yoga mat. The alternate actuator (59) is shown attached to the underside of said activity platform (11) and positioned above the actuator hole (9) in the resonant head (13) of the thumper. As a user's weight compresses the springs on the right side of the floating platform (11) the alternate actuator (59) enters through the actuator hole (9) in the resonant head (13) and activates the striker (FIG. 4) causing the beater (FIG. 8, 41) to strike the underside of the resonant head (13) and create a sound which escapes the box via the two sound ports (14) drilled into the side of the box. The box is secured shut with the base latch (16).

Figure 11:
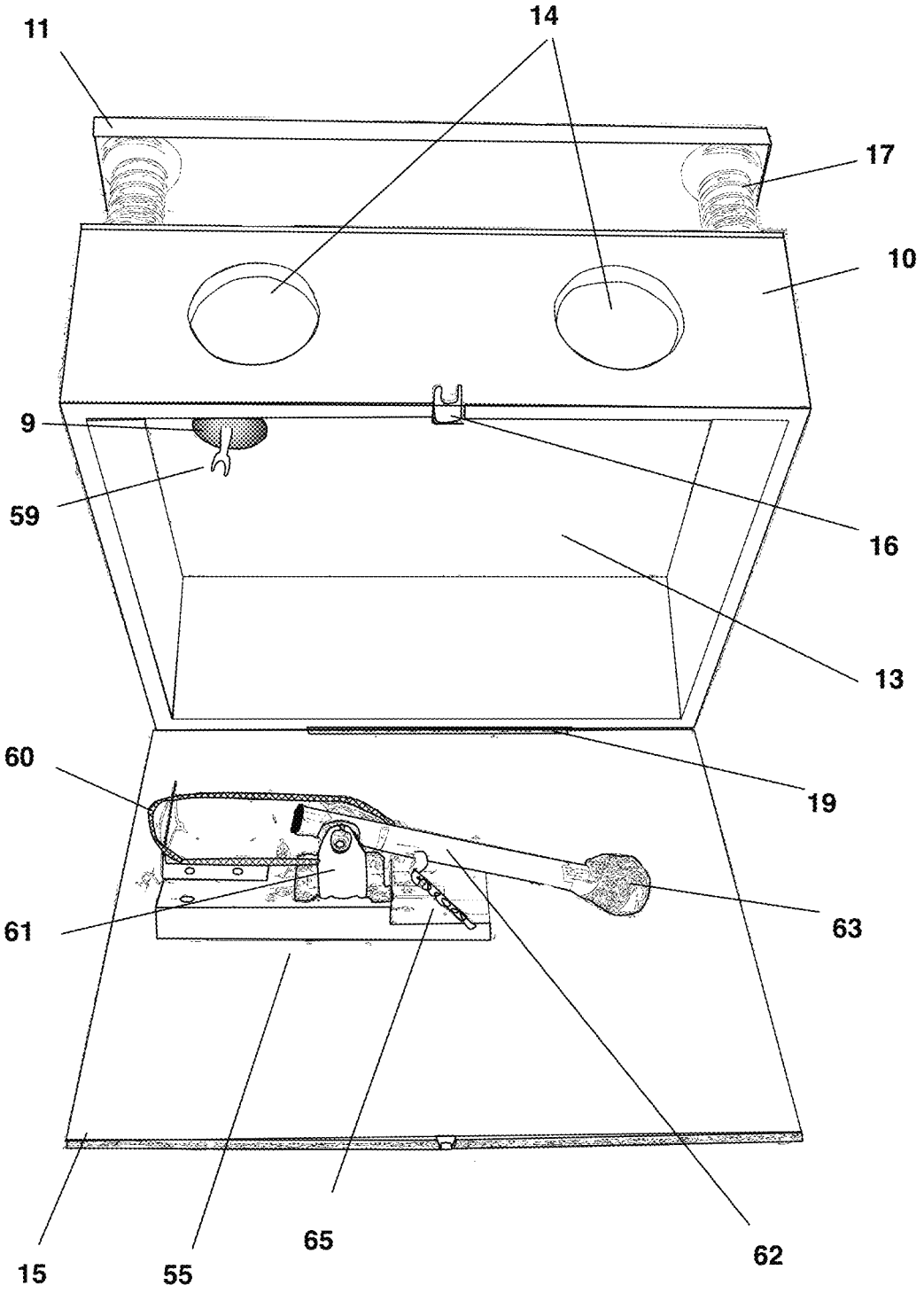
FIG. 11 is an open view of the base of the apparatus displaying the alternate actuator and alternate striking assembly in accordance with an alternate embodiment of the present invention.

Referring to FIG. 11, the thumper (10) is shown open on its hinge (19) to reveal an alternate striker (55) as situated on the base (15) of said thumper. An alternate actuator (59) is also shown entering through the actuator hole (9) in the resonant head (13) and situated in such a way that when the thumper is closed and the right side springs (17) are compressed, the alternate actuator (59) would interact with the alternate striker (55) by depressing the striker cable (60) thereby causing the alternate beater (63) to rise up on its alternate fulcrum (61) and strike the underside of the resonant head (13) causing the drum to sound through the sound ports (14). The alternate actuator (59) is shaped like a Y in order to easily catch the alternate striker cable when the activity platform (11) is depressed. This alternate version actuator/striker assembly utilizes an alternate striker overload spring (FIG. 12, 66) to avoid bottoming out.

Figure 12:
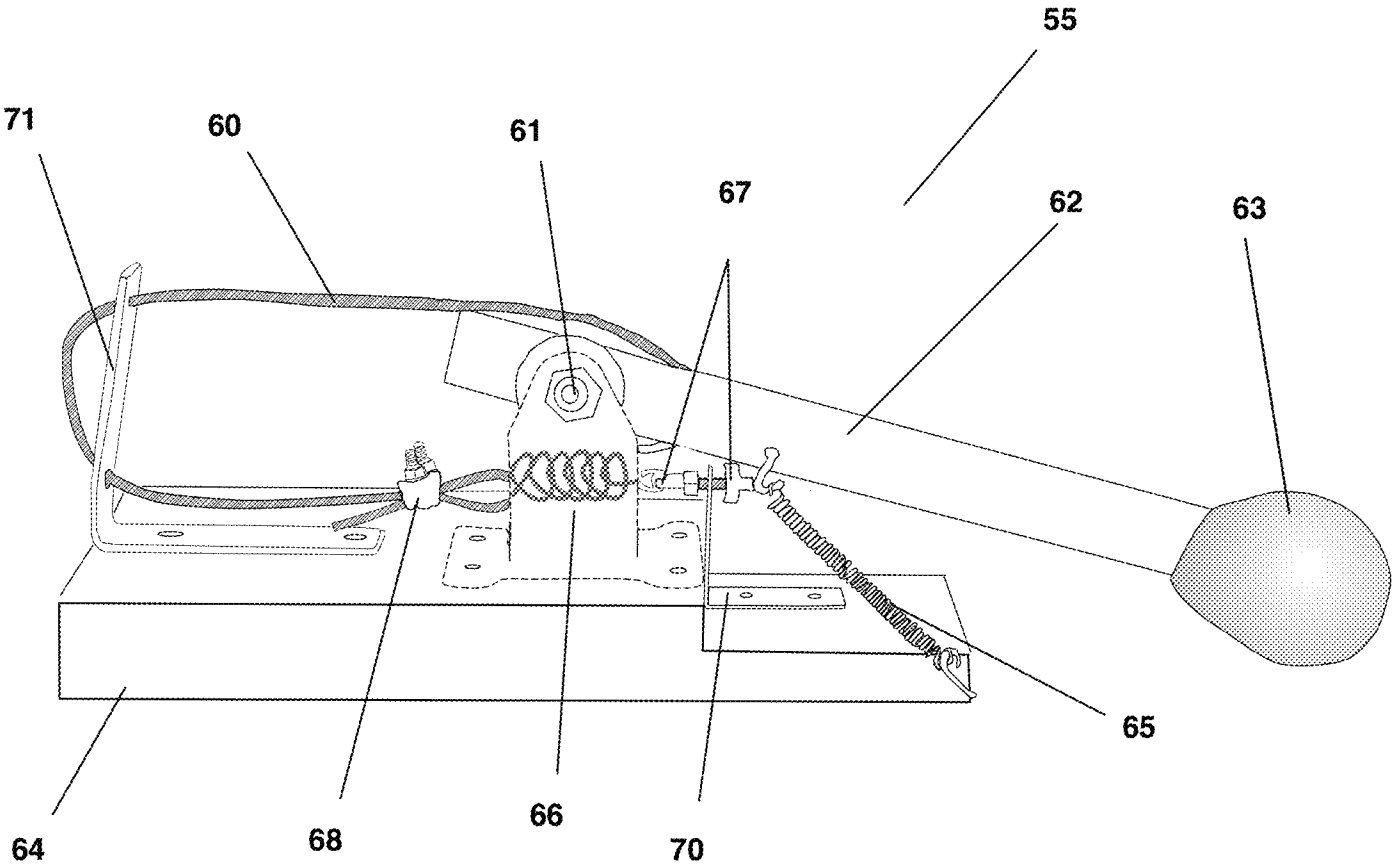
FIG. 12 is a detail view of the alternate striking assembly in accordance with an alternate embodiment of the present invention.

Referring to FIG. 12, the alternate striker (55) is shown in detail. An alternate striker support base (64) is constructed of wood or some other equally strong material upon which the mechanism can be constructed and secured. The alternate striker fulcrum (61) is secured in the center of said base (64). An alternate striker arm (62) is constructed of a tube of wood or plastic or some other equally strong material and wrapped on one end with felt or some other soft material to create the alternate striker beater (63). A hole is drilled through one end of the striker arm (62) so that it can be raised and lowered on the alternate striker fulcrum axle (61) when the alternate striker beater cable (60) is depressed. The beater cable (60) is threaded around the fulcrum axle (61), through the large "L" bracket (71) and hooked onto the alternate striker overload spring (66) which is secured to the small "L" bracket (71) and which provides extra tension relief if the beater cable (60) is tensioned above the maximum tension required for the beater (63) to hit the resonant head (FIG. 1, 13), thereby allowing the beater cable (60) to continue to depress even when the beater (63) is pressed against the resonant head (FIG. 1, 13). The alternate striker beater return spring (65) is shown attached to both the alternate striker arm (62) and the alternate striker base (64) so that once the alternate beater (63) is activated, the alternate beater return spring (65) immediately applies a return force to bring the beater back into starting position ready for the next activation. The alternate striker cable (60) is made up of twisted steel or some other equally strong and resilient material, it is looped and locked onto itself using a cable lock (68); the resulting loop is then hooked onto the alternate striker overload spring (66).

The above description and examples should not be construed as limitations on the scope of the invention. Many other variations are possible. Accordingly, the scope of the invention is determined by the claims and their legal equivalents.

The invention claimed is:

1. A percussion instrument for upright drumming and aerobic and strength training exercise comprising:

a. a thumper including: a sound box or drum having upright sides, a base, a resonant top, and an interior in which a striking mechanism is situated; an activity platform located above said sound box and of sufficient dimension and strength for a human to perform exercise actions including: standing, jumping, walking, running, bouncing, and dancing in place; said platform including an upper side and an underside, an actuator being attached to the underside for actuating said striking mechanism, b. a resilient material for securing and supporting said activity platform above the resonant top of said thumper whereby said platform and attached actuator travel vertically, said resilient material compressing and expanding in direct relation to an amount of force exerted atop said platform, c. a hole in the resonant top of said thumper to allow said actuator access to said striking mechanism, d. an upright frame holding a plurality of drums; wherein said upright frame is situated vertically in front of said thumper and is positioned and shaped in such a way that while a user is standing or in motion above said thumper, said plurality of drums are within comfortable striking distance of a user holding percussion mallets or sticks, e. wherein said upright frame is adjustable whereby said plurality of drums can be adjusted to optimal positions for muscular development when played.

2. The percussion instrument of claim 1, wherein the drum is constructed of a material selected from the group consisting of wood, plastic, and metal.

3. The percussion instrument of claim 1, wherein said activity platform is attached to the thumper with said resilient material.

4. The percussion instrument of claim 1, wherein the resilient material is selected from the group consisting of springs, hydraulics, and rubber balls.

5. The percussion instrument of claim 1, wherein the actuator is constructed of a material selected from the group consisting of springs, hydraulics, and rubber balls.

6. The percussion instrument of claim 1, wherein said upright frame is attached to said thumper.

7. The percussion instrument of claim 1, wherein the plurality of drums arranged vertically upon said upright frame contribute to the stability of said upright frame.

8. The percussion instrument of claim 1, wherein the frame is constructed of a material selected from the group consisting of metal, plastic, and wood.

9. A method of exercise comprising:

providing the percussion assembly of claim 1;

performing movements atop the activity platform to create sound by exerting downward force;

striking the plurality of drums in predetermined rhythmic patterns; and reciting mnemonic phrases to learn and remember said rhythmic patterns.

10. An assembly for striking a drum while standing upon it comprising:

a platform having an upper and lower side, and supported above a drum by a resilient material, the drum having a resonant head;

an actuator situated on the lower side of said platform aligned with a hole or passage in the resonant head or through a side of said drum allowing said actuator access to a striker, the striker comprising a lever, beater, and a fulcrum, situated inside said drum and firing toward the resonant head of said drum when actuated, wherein said actuator is comprised of two sides, an upper and a lower side, and is secured by its upper side to the lower side of said platform, wherein the lower side of said actuator is designed for soundless contact with said striker, said actuator having a length for actuating said striker when said resilient material supporting said platform is compressed by a weight of a user, wherein said striker is secured inside the resonant chamber of said drum and activated by the a downward motion of said actuator;

means for preventing said platform from bottoming out in the event said striker hits the resonant head of said drum before downward momentum of user has been counteracted by said resilient material supporting said platform.

11. The assembly of claim 10, in which a length of the lever is adjustable to account for different weights of different users, adjusting longer to sound for lighter users and shorter to sound for heavier users.

12. The assembly of claim 10, in which said means for preventing said platform from bottoming is are built into a body of the actuator.

13. The assembly of claim 10, in which said means for preventing said platform from bottoming out is built into a body of the striker.

* * * * *